United States Patent [19]

Brown et al.

[11] Patent Number: 4,590,349

[45] Date of Patent: May 20, 1986

[54] MICROWAVE COOKING CARTON FOR BROWNING AND CRISPING FOOD ON TWO SIDES

[75] Inventors: Richard K. Brown, Appleton; Raymond V. Maroszek, Neenah, both of Wis.

[73] Assignee: James River-Dixie/Northern, Inc., Norwalk, Conn.

[21] Appl. No.: 607,587

[22] Filed: May 7, 1984

[51] Int. Cl.[4] ..... H05B 6/80

[52] U.S. Cl. ..... 219/10.55 E; 219/10.55 F; 126/390; 426/243; 426/113; 99/DIG. 14; 99/451

[58] Field of Search ..... 219/10.55 E, 10.55 F, 219/10.55 M, 10.55 R; 126/390; 426/107, 110, 113, 234, 241, 243; 99/451, 644, 645, 430, DIG. 14; 206/545, 45.12, 45.2, 45.21, 45.31

[56] References Cited

U.S. PATENT DOCUMENTS

| | | | |
|---|---|---|---|
| 3,411,433 | 11/1968 | Christopher . | |
| 3,701,872 | 10/1972 | Levinson | 219/10.55 R |
| 3,835,281 | 9/1974 | Mannix | 219/10.55 E |
| 3,865,301 | 2/1975 | Pothier et al. | 426/107 X |
| 4,015,085 | 3/1977 | Woods | 219/10.55 E |
| 4,027,132 | 5/1977 | Levinson | 219/10.55 F |
| 4,132,811 | 1/1979 | Standing et al. | 219/10.55 E X |
| 4,166,137 | 8/1979 | Buck | 219/10.55 M X |
| 4,190,757 | 2/1980 | Turpin et al. | 219/10.55 E |
| 4,279,374 | 7/1981 | Webinger | 426/113 X |
| 4,283,427 | 8/1981 | Winters et al. | 426/107 |

*Primary Examiner*—Philip H. Leung

*Attorney, Agent, or Firm*—Sixbey, Friedman & Leedom

[57] ABSTRACT

A container including a paperboard carton (4) for heating and crisping two sides of food pieces having non-uniform dimensions in a microwave oven including initial and final vertically spaced food supporting panels (14,30) separated by a vertical distance exceeding the average vertical height of the food pieces. A pair of microwave interactive layers (16,102) are associated with corresponding food supporting panels (14,30) for converting microwave energy into conductive heat for browning and crisping the food pieces. Handles (8) formed in the paperboard container are provided for allowing manual inversion of the container during the crisping and cooking process to cause food pieces initially supported by the initial food supporting panel to move under the force of gravity into supporting relationship with the final food supporting panel.

13 Claims, 7 Drawing Figures

MICROWAVE COOKING CARTON FOR BROWNING AND CRISPING FOOD ON TWO SIDES

TECHNICAL FIELD

This invention relates to food packaging suitable for use in a microwave oven and particularly relates to a multi-purpose carton in which food, such as battered chicken parts, may be shipped, displayed, stored, cooked and served.

BACKGROUND ART

The high speed with which cooking occurs and the broad array of materials suitable for use in microwave ovens has created an ever-increasing demand for economical, simple, disposable containers which, when used in a microwave oven, duplicate as closely as possible the cooking results of a conventional oven. To satisfy the needs of contemporary consumers, such containers must also serve as a shipping carton, display carton and a serving dish. At the same time, it is essential that the container be sufficiently economical to allow it to be disposed after a single use. Paperboard cartons satisfy many of these performance objectives but must be designed in accordance with requirements which are dependent on the type and quantity of food to be placed and cooked in the container. In the case of refrigerated battered food products, a satisfactorily cooked product must have a crisp crust on both sides while avoiding an overcooked, scorched, burned or charred effect. Moreover, the battered food must be heated properly throughout, must not be dry or tough and must be minimally greasy or soggy.

In addition, when refrigerated or frozen battered food products of variable configurations and volumes are to be cooked, such as is the case with chicken legs, wings and breasts, a versatile microwave cooking container is needed which will accommodate a variety of differently sized foods while also applying conductive heat to both sides of the product and allowing controlled drainage and absorption of liquids, such as water and grease, which are released primarily during the latter part of the cooking process.

An important attempt to produce a container to solve many of the problems discussed above is disclosed in the patent to Turpin (U.S. Pat. No. 4,190,757). This patent teaches that, by placing precooked battered food products in a paperboard container having two vertically spaced microwave energy absorbers, such as an interactive layer which converts microwaves into heat, in contact with the food product on its top and bottom, conductive heating will both dry out moisture released by the product during cooking and crisp its top and bottom. However, this container neither provides for disposal through absorption or otherwise of non-evaporable grease released during cooking nor does it produce satisfactory double-sided crisping of variously sized food products without redesign of the carton dimensions. Moreover, the package disclosed in Turpin's patent is complicated and expensive to produce.

The patent to Levinson (U.S. Pat. No. 4,027,132) discloses another effort to overcome some of these problems through a two step method for microwave cooking of frozen filled pies. First, an inverted pie which has been placed onto a water-absorptive material is set on a perforated metal plate and is exposed to microwaves in order to bake its bottom crust and filling.

Then the pie is righted into an upright position and further exposed to microwave energy until the raw top pie crust bakes. Throughout this process, a paper pie plate surrounding the pie absorbs shortening released from the crust during baking. However, this patent does not disclose a disposable carton which can be used for both the sale and preparation of refrigerated and frozen battered foods, nor does it disclose a carton which can be used with foods of various sizes to cause crisping of both sides of the food through conductive heating conveyed by a microwave absorptive layer.

The use of any type of microwave reflective or absorptive material in a paperboard carton always presents the possibility of charring or even burning of the food and/or the paperboard material of which the carton is made. Attempts to avoid the danger of charring of the paperboard have normally resulted in the use of an entirely separate element arranged to be placed between the food and the food support or in a complicated outline for the microwave interactive layer which is different from the outline of the paperboard blank on which the interactive layer is supported such as illustrated in the patent to Pothier (U.S. Pat. No. 3,865,301). These prior designs for the microwave interactive layer can add significantly to the cost of the final carton and allow limited flexibility in carton design. Furthermore, it has been discovered that as grease separates from a batter or crust during cooking, it gravitates to the bottom of the container and starts to produce a frying effect which, in turn, creates an adhesion between the crust and the metallized surface on which it rests, making removal difficult, as well as retaining grease on the food product itself. The patent to Winter (U.S. Pat. No. 4,283,427) suggests a solution to the sticking problem by teaching the application of a substantially grease-resistant material to the top of an insert pouch on which a food product would be cooked. Further disclosure concerning stick-resistant coatings is discussed in the patent to Webinger (U.S. Pat. No. 4,279,374), but this reference in no way suggests solutions to the many other problems associated with producing an ideal microwave carton for battered food.

A number of patents have disclosed solutions to some of the specific problems enumerated above, but each has failed to eliminate all of the problems solved by the invention disclosed herein. For example, the patent to Christopher (U.S. Pat. No. 3,411,433) discloses a baking container foil having a bottom layer which absorbs grease and moisture flowing during baking to prevent adhesion, but the foil is not usable in a microwave oven and does not address the problem of crisping both the top and the bottom of a food product. The patent to Woods (U.S. Pat. No. 4,015,085) does disclose a prepackaged structure for use with refrigerated or frozen food designed for exposure to microwaves which also has a moisture absorbent layer on the bottom of the package, but this layer actually prevents crisping of the bottom of the foodstuff since it is not microwave absorbent, and the package makes no provision for crisping the top of a foodstuff. A microwave implement having adjustable shelves which convert microwaves to heat and are placed in contact with opposing sides of a foodstuff to crust both sides thereof is disclosed in the patent to Levinson (U.S. Pat. No. 3,701,872). However, the Levinson patent is not designed for packaging, storage and subsequent sale of refrigerated battered foods, as is the subject of this invention, nor is it an economical, disposable paperboard carton.

Thus, it has remained an elusive goal in the microwave container art to produce a "cook-in" container for refrigerated or frozen battered foodstuffs which is inexpensive, simple to manufacture, disposable, capable of crisping both sides of a product while preventing buildup of grease and flexible enough to handle foodstuffs of various sizes.

DISCLOSURE OF THE INVENTION

It is the primary object of the subject invention to overcome the deficiencies of the prior art by providing a microwave container for heating and crisping two sides of non-uniformly dimensioned food.

A further object of the invention is to provide a container for heating and crisping foods having non-uniform dimensions in a microwave oven. The container has both initial and final food supporting means which are separated by a distance which normally exceeds the vertical height of the foods to be heated and crisped therein. Food rests on the initial food supporting means only during the initial phase of exposure to microwaves when the initial food supporting means is placed below the final food supporting means and rests on the final food supporting means only during the later phase of exposure to microwaves after the container has been inverted and the final food supporting means is placed below the initial food supporting means.

Still another object of this invention is to provide a container for heating and crisping foods having non-uniform dimensions in a microwave oven, wherein the container has initial and final food supporting means which are separated by a distance which normally exceeds the vertical height of the foods to be heated and crisped therein and also has turning means operatively connected with the initial and final food supporting means to allow manual inversion of the container during the crisping and cooking process.

Yet another object of this invention is to provide a container manufactured from two separate unitary paperboard blanks, one of which forms an outer carton and includes a microwave interactive layer for crisping one side of food placed in the carton while the other forms an insert which also has a microwave interactive layer for crisping another side of the food pieces placed therein.

Still another object of this invention is to provide a microwave container for crisping two sides of food pieces placed therein which includes a perforated microwave interactive layer placed in contact with an absorptive paperboard material so that grease and moisture released during the heating and crisping process can flow through the microwave interactive layer and be absorbed by the paperboard material.

Yet a further object of this invention is to provide a container for crisping both sides of food pieces which is formed from a single unitary blank having a microwave interactive layer laminated on one side thereof and including an inset composed of a perforated microwave interactive layer and an absorptive layer.

Yet another object of this invention is to provide a method for microwave cooking different sizes of food pieces including the steps of (1) erecting a container having an initial and final food supporting panel separated by a vertical distance normally greater than the height of any food pieces container therein; (2) inserting the container into a microwave oven so that the food pieces are biased toward the initial food supporting panel; (3) exposing the container to microwaves; (4) turning the container over after approximately half of the cooking process is completed so that the food pieces contained therein will drop from the initial food supporting panel onto the final food supporting panel; and (5) again exposing the container to microwaves to complete cooking of the food pieces.

Other and more specific objects of the invention may be understood from the following Brief Description of the Drawings and Best Mode for Carrying Out the Invention.

BEST MODE FOR CARRYING OUT THE INVENTION

Figure 1:
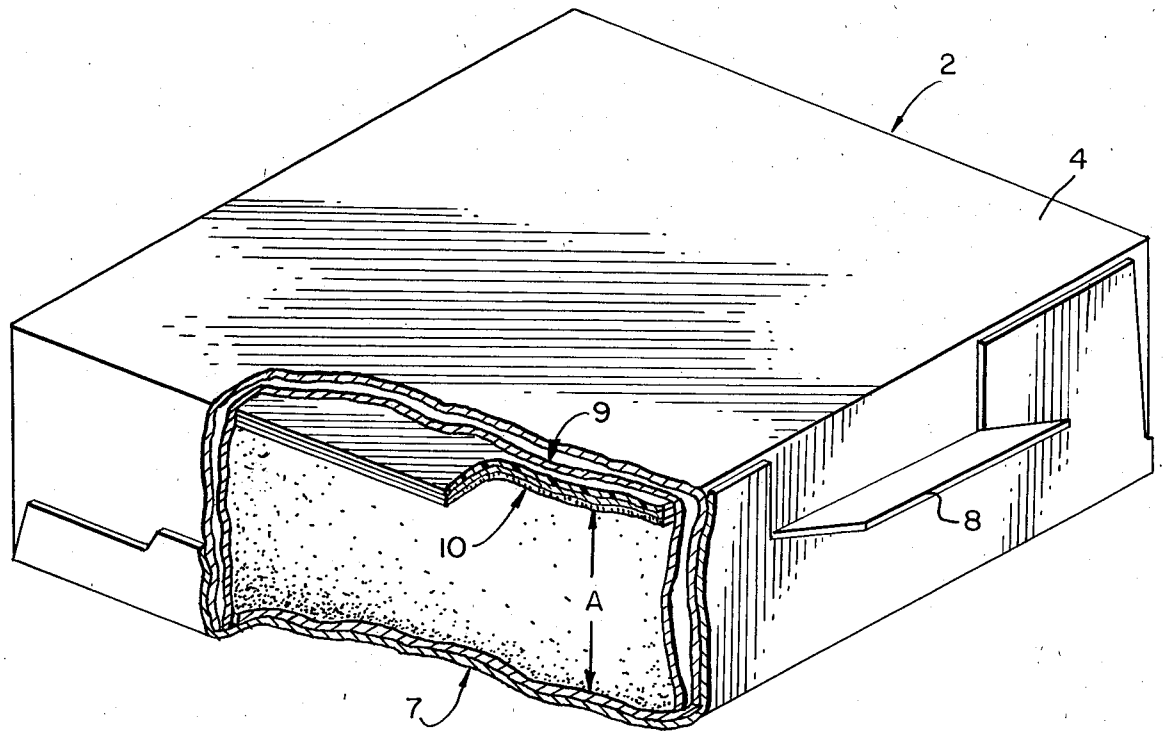
FIG. 1 is a cutaway, front perspective view of a preferred embodiment of a microwave package designed in accordance with this invention.

For a clear understanding of the subject invention, reference is initially made to FIG. 1 in which a microwave food package assembly 2 designed in accordance with the subject invention is illustrated. More specifically, the package assembly 2 includes an outer package 4 formed from a first paperboard blank and an insert 6 formed from a second paperboard blank. The outer carton 4 serves to protect the food pieces during shipment and to crisp one side of the food pieces during the initial phase of their exposure to microwaves for cooking. The outer carton 4 has dimensions which will accommodate various sizes of food pieces. In particular, package assembly 2 includes an initial food supporting means 7 for initially supporting food when the package assembly 2 is oriented as illustrated in FIG. 1 and a final food supporting means 9 for supporting food when the package assembly 2 is inverted. The initial and final food supporting means are separated by a vertical distance a which exceeds the normal vertical height of food pieces placed within the package assembly. Distance a can, for example, be $1\frac{3}{4}''$, but this distance should not normally greatly exceed the average vertical height of food pieces to be placed in the carton. Food pieces with a vertical height greater than a may be placed within the carton; however, this will cause outward bowing of the carton. The distance requirements for a are necessitated by virtue of the fact that food pieces, like battered chicken pieces, do not come in uniform sizes so the package must accommodate non-uniform sizes while still providing proper crisping through the initial and final crisping means.

Turning means, such as two handles 8 disposed on opposite sides of outer carton 4 enable the user to manually turn the package over during the cooking process and remove the package after cooking. Only one handle is visible in FIG. 1. Insert 6 is positioned within the package assembly 2 in an inverted position during the initial phase of cooking and serves to support the food pieces after the package has been turned over by use of handles 8. Insert 6 includes a two-layered inset 10 for supporting and crisping one side of the food pieces after inversion and for absorbing moisture and grease released during the latter phase of the cooking process.

The unique elements of package assembly 2 will be better understood after an explanation of the production, erection, assembly and various special features of each of the two paperboard blank components making up package assembly 2.

Figure 2:
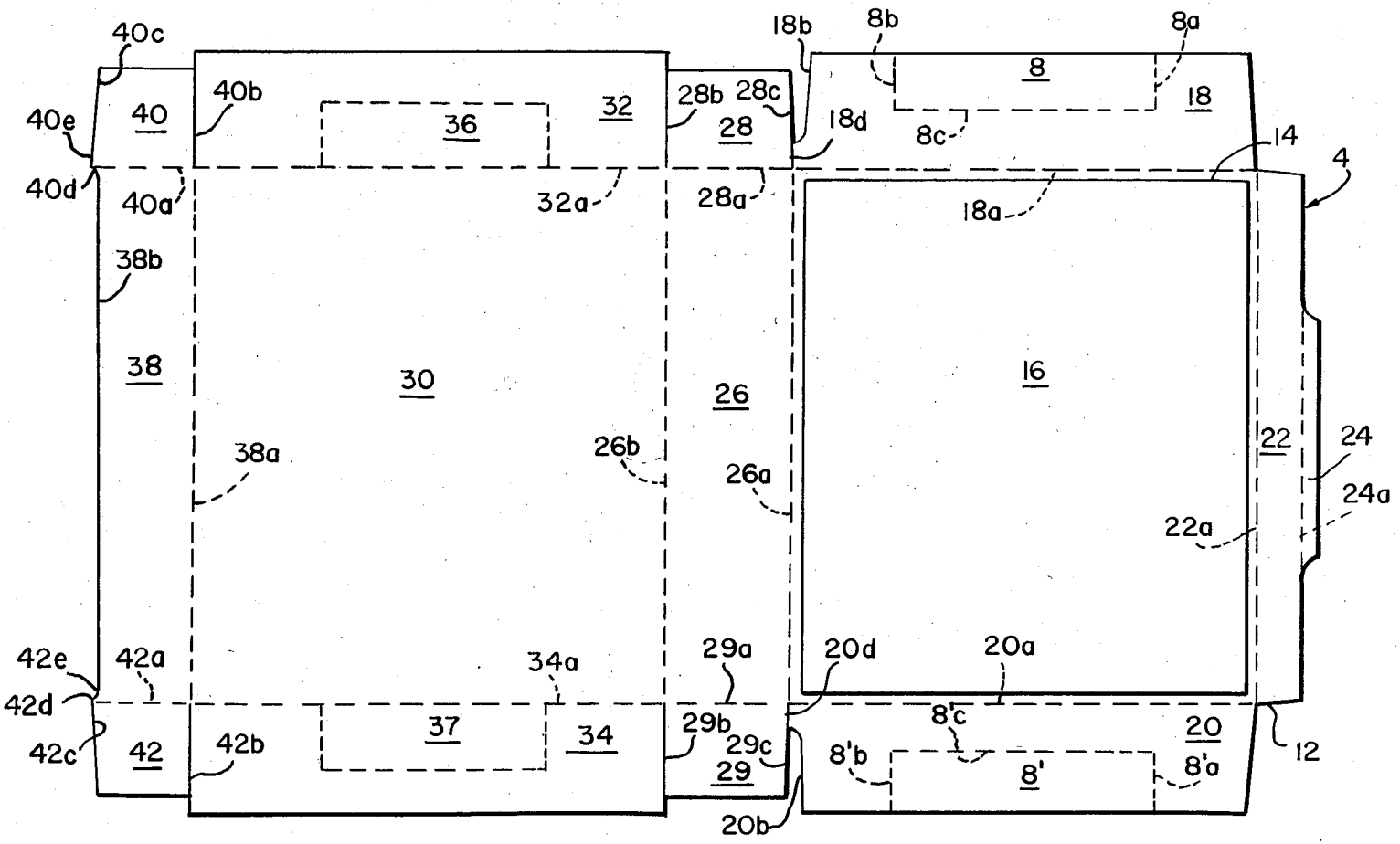
FIG. 2 is an plane view of a paperboard blank from which the outer carton of FIG. 1 may be formed.

Outer carton 4 is formed from a single unitary paperboard blank 12, a plane view of which is shown in FIG. 2. Paperboard has a number of desirable characteristics which makes it ideally suited as the primary structural component of a disposable cook-in microwave container. In particular, paperboard is strong, microwave transparent, easily adapted to receive advertising display graphics and easily handled during container assembly. All of these advantages are enhanced when combined with its recycleability and biodegradability.

Referring more specifically to the blank of FIG. 2, it is apparent that the blank is cut and scored along two perpendicular sets of parallel lines to form a plurality of interconnected panels and flaps including the major panel 14 which may be referred to as initial food supporting panel, and to which may be laminated an initial crisping means for converting microwave energy into heat capable of crisping the surface of food pieces being supported by the initial food supporting panel 14. The initial crisping means may be formed from a microwave interactive layer 16 constructed from a metallized polyester which is laminated onto initial food supporting panel 14. Microwave interactive layer 16 and initial food supporting panel 14 together form the initial food supporting means of package assembly 2. Two outer side panels 18 and 20 are connected along fold lines 18*a* and 20*a*, respectively, to initial food supporting panel 14. Each outer side panel includes a handle 8 and 8′, respectively, defined on two opposing sides by perforated slit lines 8*a*, 8*b*, 8′*a* and 8′*b*, respectively, and on one remaining side by a fold line 8*c* and 8′*c*, respectively. Each outer side panel 18 and 20 is generally trapezoidally shaped and includes an innermost shorter edge 18*b* and 20*b*, respectively. The initial food supporting panel 14 is attached along fold line 22*a* to outer front panel 22 which includes a tab section 24. This tab section 24 may be biased away from outer carton 4 after erection due to a score line 24*a* and provides, therefore, a method for opening package assembly 2 after microwave cooking as described below. On the edge opposite fold line 22*a*, initial food supporting panel 14 is connected along fold line 26*a* to back panel 26 to which two opposed tabs 28 and 29 are also foldably connected along lines 28*a* and 29*a* respectively. Back panel 26 is further foldably connected along fold line 26*b* to final food supporting panel 30 to which two inner side panels 32 and 34 are foldably connected along fold lines 32*a* and 34*a*, respectively. Each inner side panel 32 and 34 includes an indentation 36 and 37 scored therein, respectively, which, after erection of the outer carton 4 as described below, coincides with and opposes the handles 8 and 8′ contained in corresponding outer panels 18 and 20. The indentations assist in permitting handles 8 and 8′ to be moved into their operative positions as is explained morely fully below. Inner side panels 32 and 34 and outer side panels 18 and 20 may all have the same vertical heights. Final food supporting panel 30 is further connected along fold line 38*a* to inner front panel 38 to which two opposed tabs 40 and 42 are hingedly connected along fold lines 40*a* and 42*a*, respectively. FIG. 2 also shows that edges 40*c* and 42*c* of tabs 40 and 42, respectively, are flared in a direction opposite to edge positions 18*d* and 20*d* as edges 40*c* and 42*c* approach foldlines 40*a* and 42*a* and terminate with sharp reverse angular edges 40*d* and 42*d*, respectively, before joining line 38*b*, thereby forming protrusions 40*e* and 40*d* which become somewhat flattened when the front side of outer carton 4 is closed during the assembly steps described above. These features prevent binding of flap 22.

The use of a single unitary blank design significantly reduces the complexity of forming outer carton 4 especially when the blank is prepared for shipment in a flattened condition to the point of packaging. To achieve this condition, inner front panel 38 is folded 180° along line 38*a* to lie flat against final food supporting panel 30 not illustrated. Next, initial food supporting panel 16 is folded 180° along line 26*a* so that outer front panel 22 is brought into overlying contact with inner front panel 38. As a result of these operations, panels 22 and 38 may be connected together by use of adhesive, thermoplastic material or other type of suitable mechanical or chemical securing means applied prior to or simultaneously with the folding operations described above. Upon completion of these steps, a flattened tube is formed which may be shipped from the point of manufacture of the outer carton to a point of packaging at which the outer carton may be erected and food pieces inserted therein for shipment to points of purchase by the ultimate user.

Figure 3:
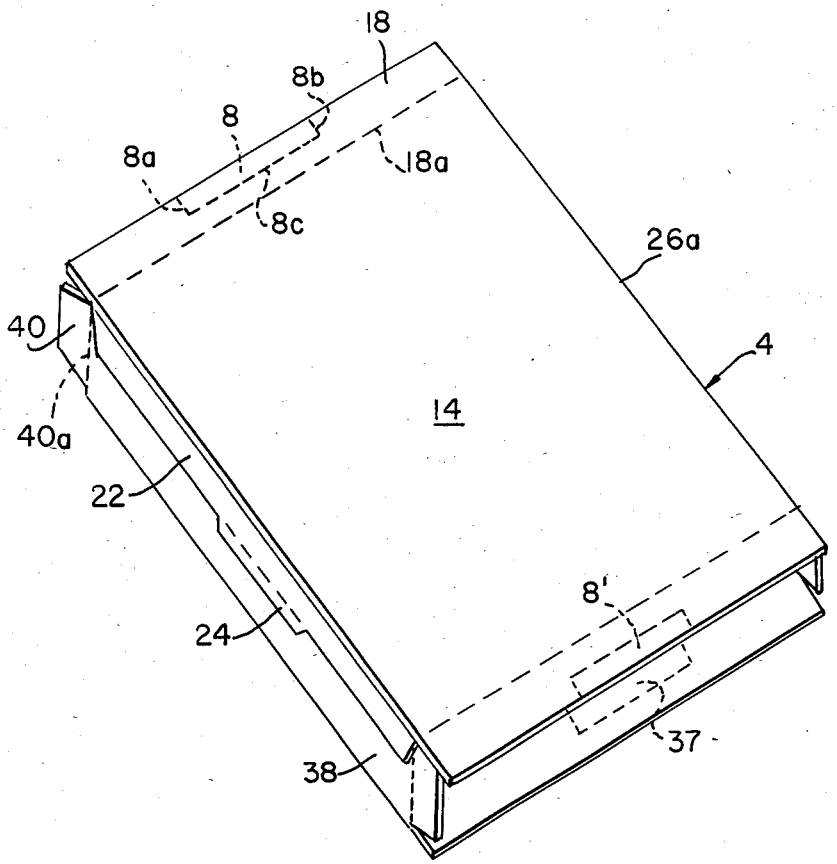
FIG. 3 is a perspective view of the outer carton after erection at the point of packaging.

FIG. 3 illustrates the configuration of outer carton 4 when it has been erected at the point of packaging in preparation for insertion of insert 6 which will be described in more detail below. In order to reach this next stage, the flattened tube resulting from the steps described above, is subjected to forces which cause back panel 26 (not illustrated) and adhered outer front panel 22 and inner front panel 38 to assume positions which are perpendicular to initial food supporting panel 14 and final food supporting panel 30.

One end of outer carton 4 may be closed prior to insertion of the insert 6, although it is entirely possible to leave both ends open until insert 6 has been positioned within erected outer carton 4. If it is desired to close one end prior to insertion, this may be done by folding in tab 28 (not illustrated) and tab 40 along line 28*a* (not illustrated) and 40*a*, respectively. Next, inner side panel 32 (not illustrated) may be folded upwardly along fold line 32*a*, and outer side panel 18 may be folded downwardly along fold line 18*a* to bring outer side panel 18 into face to face contact with inner side panel 32. An adhesive may be applied either to inner side panel 32 or outer side panel 18 or to both panels prior to closing so that they remain in face to face contact.

It should be noted that after the above assembly steps are completed, a small space exists between the outer edge of handle 8 and the opposing face of inner side panel 32, which is created by the space left by scoring indentation 36. This space is significant in that it allows the ultimate user to obtain easy leverage on handle 8 by slipping a fingernail into the space and exerting pressure outwardly away from outer carton 4 to tear handle 8 along perforated slit lines 8*a* and 8*b* to fold the handle downwardly, as explained below, along fold line 8*c*.

Figure 4:
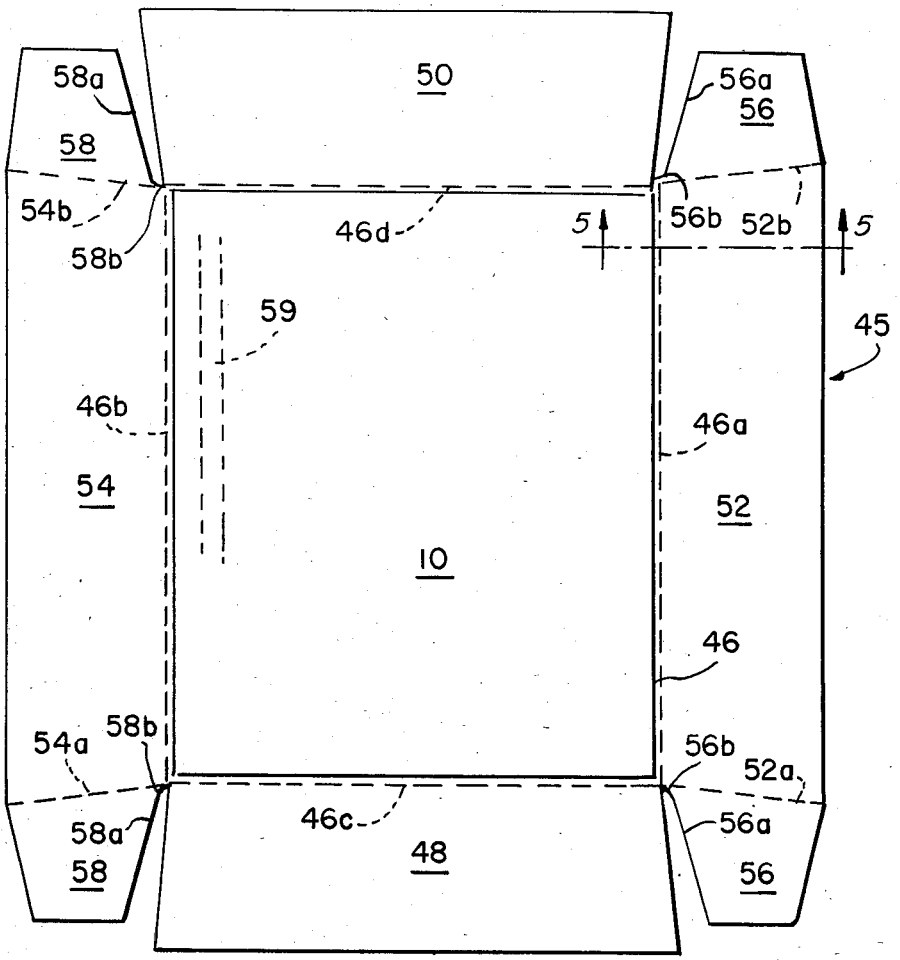
FIG. 4 is a plane view of the paperboard blank from which the insert of FIG. 1 may be formed.

Reference is now made to the configuration and method of assembly of insert 6. In particular, FIG. 4 provides a plane view of the single unitary paperboard blank 45 from which insert 6 is made. This blank includes a central panel 46, two laterally opposed end panels 48 and 50 and two laterally opposed side panels 52 and 54, each of which includes a pair of laterally opposed sealing flaps 56 and 58 hingedly connected thereto along fold lines 52*a*, 52*b*, 54*a* and 54*b*, respectively. Side panels 52 and 54 are connected along fold lines 46*a* and 46*b* to central panel 46, while end panels 48 and 50 are connected, respectively, along fold lines 46*c* and 46*d* to central panel 46. Central panel 46 generally corresponds in shape with final food supporting panel 30 of outer carton 4. However, central panel 46 has a width dimension which is slightly less than the comparable width dimension of the end opening in outer carton 4 shown in FIG. 3 through which the tray is inserted during the assembly process.

Figure 5:
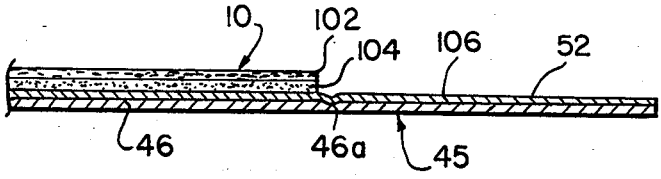
FIG. 5 is a fragmentary cross-sectional view of line 5—5 as it appears in FIGS. 4 and 7.

Insert 6 also includes a two-layered inset 10, the construction of which can be more clearly understood by reference to FIG. 5 which is a partially broken away cross section taken along lines 5—5 of FIG. 4. The first layer 102 of this inset is a perforated microwave interactive material which may be formed by a metallized layer of polyester film. This layer converts a substantial portion of the microwaves which impinge upon it into heat, thereby crisping the surfaces of food pieces in contact therewith. Other types of microwave interactive coatings which heat up to brown or crisp food may be used such as disclosed in U.S. Pat. No. 4,190,757. The perforations (illustrated by slits 59 in FIG. 4) serve to allow grease and moisture released during the cooking process to pass through microwave interactive layer 102 so they will be absorbed by second absorptive layer 104 which may be composed of a paperboard material which is substantially thicker than microwave interactive layer 102. A thin film of heat responsive material 106, such as polyethylene, may be coated onto the inside surface of the paperboard forming the outer carton. Upon exposing the package to microwaves, the heat generated in layer 102 causes material 106 to become tacky thereby adhering inset 10 to central panel 46 of insert 6. The two layers of inset 10 together comprise the final crisping means of package assembly 2 while inset 10, together with final food support panel 30 of outer carton 4 and central panel 46 of insert 6 comprise the final food supporting means of package assembly 2.

To erect insert 6, closing flaps 56 and 58 are folded upwardly along the fold lines 52*a*, 52*b*, 54*a* and 54*b*, respectively. Edges 56*a* and 58*a*, respectively, of closing tabs 56 and 58 include a small sharply angled portion 56*b* and 58*b* separating the tabs from the adjacent edges of end panels 48 and 50 before resuming a more gradual angle as shown in FIG. 4. This feature permits these flaps to function not only as closing tabs against which end panels 48 and 50 may be placed in face to face contact to seal and erect the tray but also to form a type of leakproof insert.

To complete the assembly of a package in accordance with this invention, food pieces such as battered chicken, are placed in the insert 6 on inset 10. Next, insert 6 is slid into outer carton 4 through the remaining opening formed by inner side panel 34 and outer side panel 20. Finally, the open end or ends of outer package 4 are closed by folding in tabs 29 and 42, folding upwardly inner side panel 34 along fold line 34*a* and folding downwardly outer side panel 20 along fold line 20*a*. An adhesive is applied either to inner side panel 34 or to outer side panel 20 or to both panels prior to closing so that they remain in face to face contact. A similar operation is performed to close the upper end of outer carton 4 if this has not already been done.

Package assembly 2 is delivered to a customer as a sealed package containing refrigerated or frozen food such as battered chicken pieces of variable size. In order to use it, the customer places the package directly into a microwave oven following directions on the package so that it is oriented initially with insert 6 in an inverted, upside down position in contrast with the manner in which insert 6 was originally placed within outer carton 4 during the assembly process. This orientation is depicted in the cut away perspective view of FIG. 1. By so doing, the customer causes the food pieces to initially be in contact with microwave interactive layer 16 which will heat up on exposure to microwave energy and conduct heat to the food pieces resting thereon, starting the thawing process if frozen food is used, or beginning the cooking process if refrigerated foods are used. In either event, the total cooking time for the food pieces is precalculated so that after approximately half of the total period has expired, the food surface in contact with microwave interactive layer 16 has begun to crisp. Then, following instructions, the user interrupts microwave radiation of package assembly 2 and manually inverts the package assembly 2 by use of handles 8 and 8'. This inversion causes the food pieces to fall by force of gravity onto inset 10 after which package assembly 2 is further exposed to microwave energy for the balance of the cooking period. During this latter half of the cooking process, greases and moisture are released from the food pieces. This grease and moisture passes through the microwave interactive layer 102 of inset 10 to the second paperboard absorptive layer 104 where it is trapped. This important feature of the subject invention prevents food pieces from becoming soggy while assisting them to become crisp.

In order to serve the food pieces within the package assembly, the user grips tab section 24 on outer front panel 22 and pulls it away from the package to separate outer front panel 22 from its adhering relationship with inner front panel 38. After so doing, the center portion of panel 30 defined by a pair of double cut score lines (not shown) may be pivoted upwardly along foldline 26*a* to form an open topped serving tray. Both outer carton and insert 6 are totally disposable, so that the customer may save or throw them away, as desired.

Figure 6:
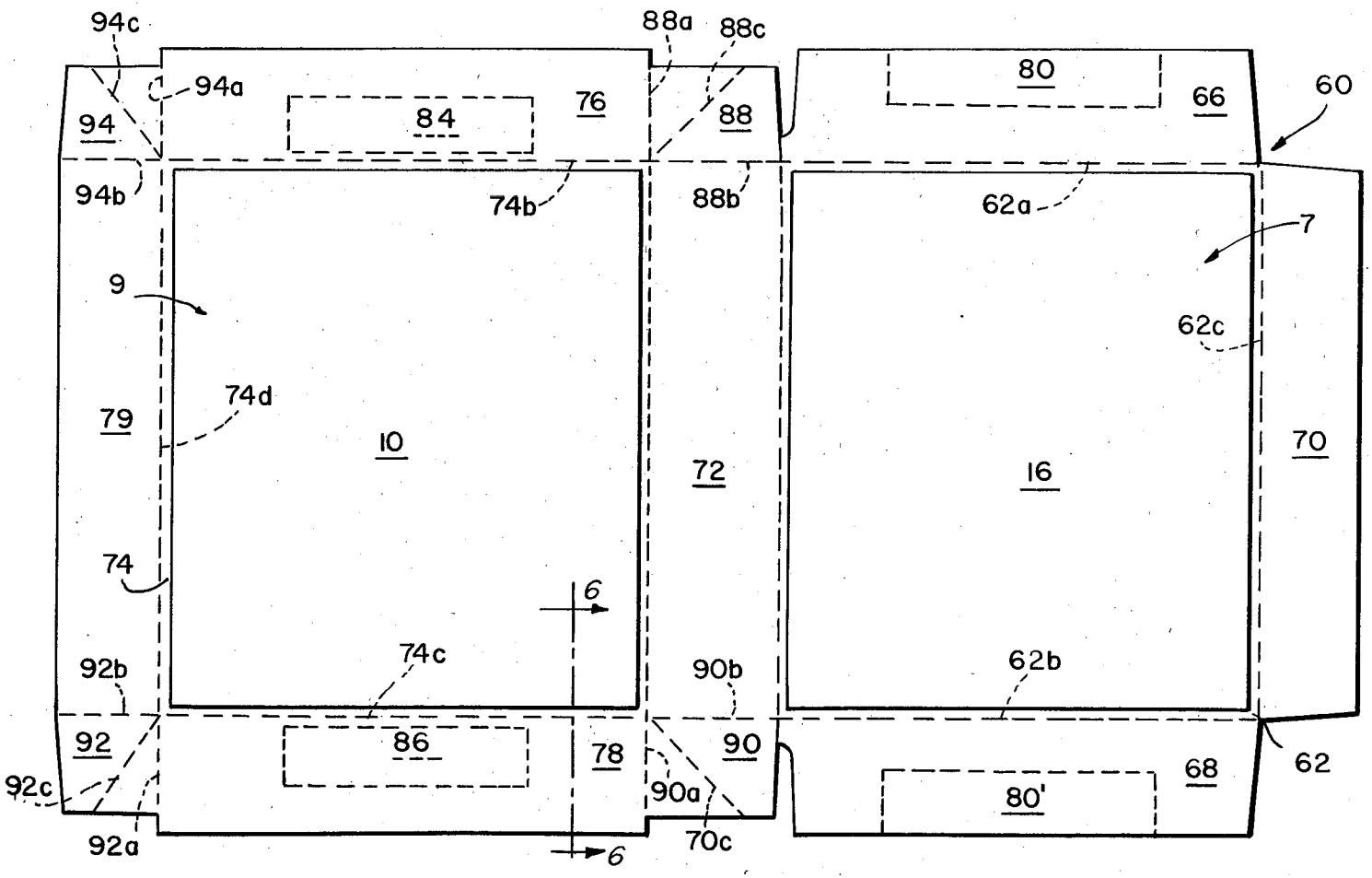
FIG. 6 is an plane view of a paperboard blank for forming an alternative embodiment of the other carton of the subject invention.

A flat single unitary blank 60 for forming an alternative embodiment of a package assembly designed in accordance with the subject invention is shown in FIG. 6. When erected, the blank of FIG. 6 forms a package assembly 2' illustrated in FIG. 7. This embodiment includes initial food supporting means 7 comprising an initial food supporting panel 62 on which is laminated a microwave interactive layer 16 of the same type shown in the embodiment of FIGS. 1–5. Similar to the preferred embodiment, this blank includes outer side panels 66 and 68, outer front panel 70 and back panel 72, all of which are connected along fold lines 62*a*, 62*b*, 62*c* and 62*d*, respectively, to initial food supporting panel 62. This blank also includes final food supporting means 9 including a final food supporting panel 74 which is connected to back panel 72, inner side panels 76 and 78 and inner front panel 79 along fold lines 74*a*, 74*b*, 74*c* and 74*d*, respectively. Further, handles 80 and 80' are integrated into outer side panels 66 and 68 and scored indentations 84 and 86 are also integrated into side panels 76 and 78, both as in the preferred embodiment, described above. However, this embodiment differs from the above-described preferred embodiment in several significant ways. First, no insert is used in this embodiment. Rather, inset 10 of the type illustrated in FIG. 5 is placed in direct contacting relationship with final food supporting panel 74. An adhesive may be used to cause inset 10 to adhere to final food supporting panel 74 during the food packaging process before delivery to the ultimate user. Alternatively, the food packager may choose to place inset 10 loosely into the outer carton. Subsequent exposure of inset 10 to microwave radiation and conductive heat in package assembly 2' in the latter half of the cooking process will cause heat responsive layer, like layer 106 of FIG. 5, to partially soften bringing inset 10 into adhesive relationship with final food supporting panel 74. In this way, food pieces placed within package assembly 2' will be crisped on both sides in the alternative embodiment in the same manner as they are in the preferred embodiment. A further difference in the alternative embodiment is the inclusion of webbed closing tabs 88, 90, 92 and 94 in place of tabs 28, 29, 40 and 42 in the preferred embodiment. Webbed closing tabs 88 and 94 are foldably attached along fold lines 88*a* and 94*a*, respectively, to inner side panel 76 and are foldably attached on another edge along fold lines 88*b* and 94*b* to back panel 72 and inner front panel 79, respectively. Similarly, webbed closing tabs 90 and 92 are attached along fold lines 90*a* and 92*a* to inner side panel 78 and along fold lines 90*b* and 92*b* to back panel 72 and inner front panel 79, respectively. When package assembly 2' is erected, webbed closing tabs 88, 90, 92 and 94 are folded along lines 88*c*, 90*c*, 92*c* and 94*c* to form moisture-proof, grease-proof sealed corners in the package assembly 2'.

The final difference between the alternative embodiment and the preferred embodiment is the inclusion of an outer front panel 70 which has nearly the same vertical height as inner front panel 78. This configuration of the outer front panel 70 is necessitated by the fact that in the alternative embodiment, package assembly 2' is partially erected by folding webbed closing tabs 88, 90, 92 and 94 inwardly toward the center of the package along fold lines 88*c*, 90*c*, 92*c* and 94*c*, respectively, thereby causing inner side panels 76 and 78, as well as inner front panel 79 and back panel 72 to be drawn upwardly from a position parallel to final food supporting panel 74 to one perpendicular to final food supporting panel 74. Further, since fold lines 88*c*, 90*c*, 92*c* and 94*c* are placed off the diagonal center of the respective webbed closing tabs, a portion of each webbed closing tab from the reverse side of the view presented in FIG. 7 of the blank is brought into contacting face to face relationship with inner side panels 76 and 78, respectively. An adhesive is applied either to the appropriate portion of inner side panels 76 and 78 or to the respective webbed closing tabs prior to erection in order to cause the tabs and panels to remain in their erected positions. Thereafter, food pieces are placed onto inset 10 and initial food supporting panel 60 is folded 180° along fold line 62*d*. Finally, outer side panels 66 and 68 and outer front panel 70 are folded 90° downwardly to bring them into face to face contact, respectively, with inner side panels 76 and 78 and inner front panel 79. An adhesive may be applied prior to assembly to either or both of the respective inner and outer front and side panels to cause the package assembly to be sealed after following the above steps. For marketing to the consumer, package assembly 2' must be inverted or instructions must be provided to the ultimate user so that the food pieces rest on microwave interactive layer 16 during the initial phase of exposure to microwaves. The subsequent cooking process is identical to that for the preferred embodiment described above.

Figure 7:
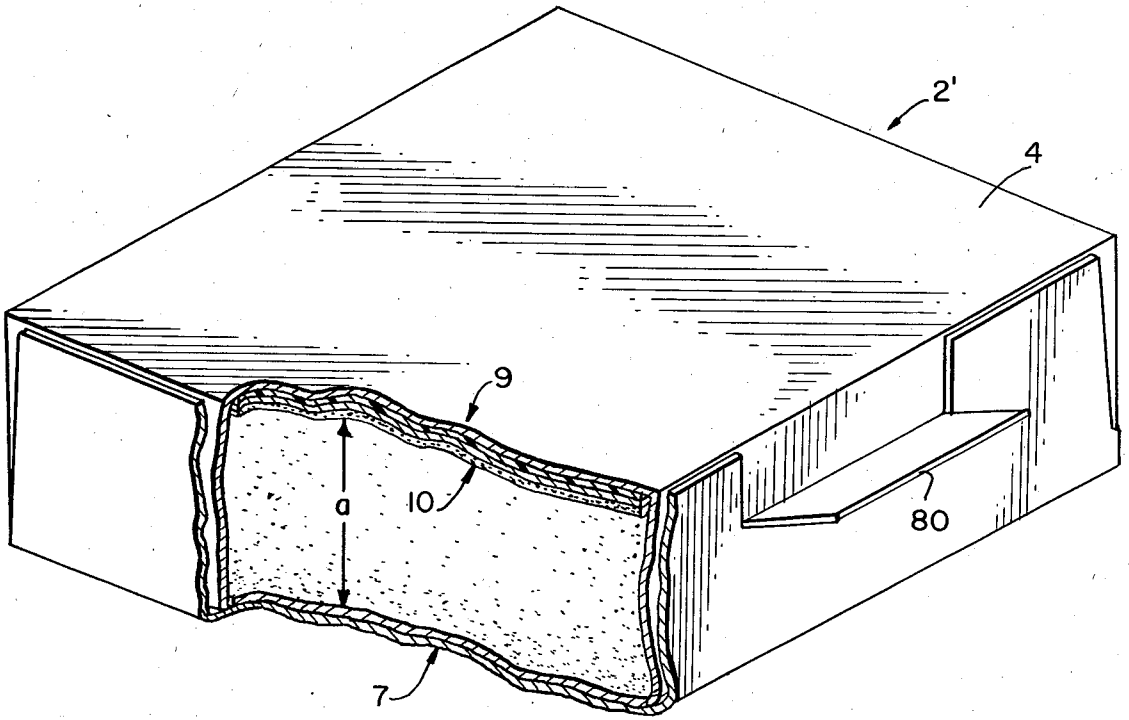
FIG. 7 is a cutaway, front perspective view of the alternative embodiment formed from the blank of FIG. 6.

The alternative embodiment is useful to food packagers who are using straight line sealing equipment. However, this embodiment may be more complex and expensive to manufacture than the preferred embodiment. FIG. 7 is a cut-away front, perspective view of the microwave package assembly 2' designed in accordance with the alternative embodiment of this invention. As in the preferred embodiment, distance a shown in FIG. 7 must normally exceed the vertical height of the food pieces placed within the package assembly so that the package assembly 2' can accommodate non-uniform sizes of food, like battered chicken pieces, and still heat and crisp food properly.

INDUSTRIAL APPLICABILITY

This invention has particular utility in the packaging of food pieces for distribution and sale in refrigerated and frozen display cases now common in most grocery stores. The disclosed package assembly is ideally suited for packaging, shipping, vending, microwave heating and serving of variety sized battered food products such as chicken which require crisping on two sides and which release moisture and grease during the cooking process. The disclosed assembly could, however, be used for a wide variety of other prepared food products.

We claim:

1. A container for use in heating and crisping first and second sides of one or more pieces of food having non-uniform dimensions in a microwave oven, comprising:

(a) vertically spaced initial and final food supporting means separated by a vertical distance which normally exceeds the vertical height of food pieces placed between said food supporting means, (b) initial and final crisping means associated with said initial and final food supporting means, respectively, for converting microwave energy into heat capable of sequentially crisping the first and second sides of the food pieces being supported by said food supporting means during the heating and crisping process, and (c) turning means operatively connected with said pair of food supporting means for allowing manual inversion of said food supporting means after the first sides have been crisped to cause food pieces initially supported by said initial food supporting means to move under the force of gravity into supporting relationship with said final food supporting means with their second sides in cooking contact with said final crisping means.

2. A container as defined in claim 1, wherein said final crisping means includes a perforated microwave interactive layer for converting a portion of the microwaves striking it into heat and for permitting passage of moisture and grease released by food during cooking and an absorptive layer for absorbing said moisture and grease.

3. A container as defined in claim 2, further including an outer carton formed from a unitary outer blank having plural panels hingedly interconnected along fold lines.

4. A container as defined in claim 3, wherein said panels of said unitary outer blank include:

(a) an initial food supporting panel;

(b) an outer front panel hingedly interconnected to said initial food supporting panel;

(c) a pair of opposed, outer side panels hingedly interconnected to said initial food supporting panel, wherein said turning means are formed within said outer side panels;

(d) a final food supporting panel;

(e) a pair of opposed, inner side panels hingedly interconnected to said final food supporting panel;

(f) an inner front panel hingedly interconnected to said final food supporting panel; and (g) a back panel hingedly interconnected on opposed sides to said initial food supporting panel and said final food supporting panel.

5. A container as defined in claim 4, where said perforated microwave interactive layer and said absorptive layer form an inset that is placed in non-adhering relationship to said final food supporting panel and wherein said outer carton includes a heat responsive layer for causing the inset to adhere to the final food supporting panel in response to heat generated during the heating and crisping process.

6. A container for use in heating and crisping two sides of pieces of food having non-uniform dimensions in a microwave oven, comprising (a) vertically spaced initial and final food supporting means separated by a vertical distance which normally exceeds the vertical height of food pieces placed between said food supporting means, (b) turning means operatively connected with said pair of food supporting means for allowing manual inversion of said food supporting means during the crisping and cooking process to cause food pieces initially supported by said initial food supporting means to move under the force of gravity into supporting relationship with said final food supporting means, and (c) initial and final crisping means, respectively, associated with said initial and final food supporting means for converting microwave energy into heat capable of crisping the surface of food pieces being supported by said food supporting means during the heating and crisping process, wherein said final crisping means includes a perforated microwave interactive layer for converting a portion of the microwaves striking it into heat and for permitting passage of moisture and grease released by food during cooking and an absorptive layer for absorbing said moisture and grease, (d) an outer carton formed from a unitary outer blank, said outer carton having plural panels hingedly interconnected along fold lines, said panels including a final food supporting panel, and (e) and inset formed from said perforated microwave layer and said absorptive layer, said inset being placed in non-adhering relationship to said final food supporting panel, wherein said outer carton includes a heat responsive layer for causing said inset to adhere to the final food supporting panel in response to heat generated during the heating and crisping process.

7. A container as defined in claim 6, wherein said initial food supporting means includes said initial food supporting panel and said final food supporting means includes said final food supporting panel.

8. A container as defined in claim 6, wherein each outer side panel inclues a pair of opposed, separation lines extending inwardly from the outer edge of said outer side panel and a fold line interconnecting said separation lines, said turning means being formed from the portion of said side panel extending between said separation lines.

9. A container as defined in claim 6, wherein each inner side panel includes an indentation scored therein which coincides with and opposes the turning means contained in the corresponding outer side panel.

10. A container as defined in claim 9, further including an insert formed from a unitary inner blank having plural panels hingedly interconnected along fold lines including (a) a central panel;

(b) two laterally opposed end panels hingedly interconnected along fold lines to said central panel;

(c) two laterally opposed side panels hingedly interconnected along fold lines to said central panel; and (d) two pair of laterally opposed sealing flaps, each hingedly interconnected along fold lines, respectively, to one of said laterally opposed side panels.

11. A container as defined in claim 10, wherein said final food supporting means further includes said central panel and wherein said final crisping means is attached to said central panel.

12. A container as defined in claim 9, wherein said back panel has two laterally opposed, webbed closing tabs hingedly connected thereto, each of which webbed closing tabs is also hingedly connected to one of said inner side panels.

13. A container as defined in claim 9, wherein said inner front panel has two laterally opposed, webbed closing tabs hingedly connected thereto, each of which webbed closing tabs is also hingedly connected to one of said inner side panels.

* * * * *